US005681440A

United States Patent [19]

Herbert et al.

[11] Patent Number: 5,681,440

[45] Date of Patent: Oct. 28, 1997

[54] ENCAPSULATED NICKEL PHOTORECEPTOR SUBSTRATE

[75] Inventors: William G. Herbert, Williamson; Geoffrey M. T. Foley, Fairport; Huoy-Jen Yuh, Pittsford, all of N.Y.

[73] Assignee: Xerox Corporation, Stamford, Conn.

[21] Appl. No.: 671,192

[22] Filed: Jun. 27, 1996

[51] Int. Cl.[6] ..... C25D 1/00

[52] U.S. Cl. ..... 205/76; 205/78; 205/67

[58] Field of Search ..... 205/67, 76, 77, 205/78

[56] References Cited

U.S. PATENT DOCUMENTS

| | | | |
|---|---|---|---|
| 4,462,873 | 7/1984 | Watanabe | 205/67 |
| 4,664,758 | 5/1987 | Grey | 204/3 |
| 4,902,386 | 2/1990 | Herbert et al. | 204/9 |
| 5,196,106 | 3/1993 | Dupree et al. | 6/6 |

*Primary Examiner*—Kathryn L. Gorgos
*Assistant Examiner*—Kishor Mayekar
*Attorney, Agent, or Firm*—T. L. Fair

[57] ABSTRACT

An electroforming process and apparatus for creating a nickel or like substrate encapsulated by another material to prevent wear to the nickel substrate. The encapsulation of the nickel substrate requires encapsulation of the inner and outer diameter of the nickel substrate. The encapsulating material must adhere to the nickel substrate. Encapsulation of the nickel substrate prevents exposure of the nickel and thus avoids the hazardous nickel dust particles that can occur when the nickel is exposed.

5 Claims, 1 Drawing Sheet

ENCAPSULATED NICKEL PHOTORECEPTOR SUBSTRATE

BACKGROUND OF THE INVENTION

This invention relates generally to an electroforming process, and more particularly, concerns a process for enabling electroforming of an encapsulated nickel photoreceptor substrate.

Electroformed nickel photoreceptor belt substrates have been made and successfully tested at one, one and one-half, and up to three pitch. However, some nickel salts are known to be potentially hazardous, thus, nickel and most nickel salts are considered suspect hazardous materials. Nickel is considered to be the most potentially hazardous, when it is finely divided (i.e. dust) because this configuration gives the nickel a maximum surface area which, under the right conditions, facilitates the nickel transformation into one or more of its salts which are known to be hazardous. Additionally, in use, the surfaces of the nickel photoreceptor belt become burnished when they contact a part which has a different relative motion. While there is no measurable loss of nickel, the device appears to be worn. Analysis of the dust in the machines which use nickel photoreceptor substrates shows that the dust contains nickel at levels which typically are four to six magnitudes below the acceptable limit for nickel dust. A source of nickel may be the wear of stainless steel components because some toner has nickel levels in excess of what is found in the machine generated dust.

Additionally, there is an aesthetic concern. The potential dust generation of nickel photoreceptor substrate belt may raise concern from customers and competitors when a burnished section of a nickel belt is observed.

The following disclosures may be relevant to various aspects of the present invention and may be briefly summarized as follows:

U.S. Pat. No. 4,902,386 to Herbert et al. discloses a cylindrical electroforming mandrel and method of fabricating and using same, the mandrel having a substantially cylindrical mandrel core having substantially parallel sides and at least one tapered end having curved sides which converge toward an apex, and a plated metal coating on the parallel sides and the tapered end.

U.S. Pat. No. 4;664,758 to Grey discloses an electroforming process comprising providing an elongated electroforming mandrel core, applying a substantially uniform coating of a molten, inert, inorganic, homogeneous, electrically conductive metal or metal alloy to the mandrel core, the metal or metal alloy having a melting point and a surface tension less than the melting point and surface tension of the mandrel core, immersing the mandrel core bearing the coating in an electroforming bath having a surface tension less than the surface tension of the metal or metal alloy, depositing an electroformed metal layer on the coating, the electroformed metal layer having a melting point greater than the metal or metal alloy, melting the metal or metal alloy, and removing the electroformed metal layer from the mandrel core.

SUMMARY OF INVENTION

Briefly stated, and in accordance with one aspect of the present invention, there is provided a method for fabricating an electroform on a mandrel, comprising: applying a layer of a first material to the mandrel surface to create an electroform; separating the layer of the first material forming the electroform from the mandrel surface; and encapsulating the first material with a second material.

Pursuant to another aspect of the present invention, there is provided an apparatus for creating an electroform comprising: a mandrel having a surface; means for applying a layer of a first material on the surface of the mandrel to form the electroform; means for separating the electroform from the surface of the mandrel; and means for encapsulating the first material of the electroform with a second material to prevent wear of the first material.

BRIEF DESCRIPTION OF THE DRAWINGS

Other features of the present invention will become apparent as the following description proceeds and upon reference to the drawing, in which.

Figure 1:
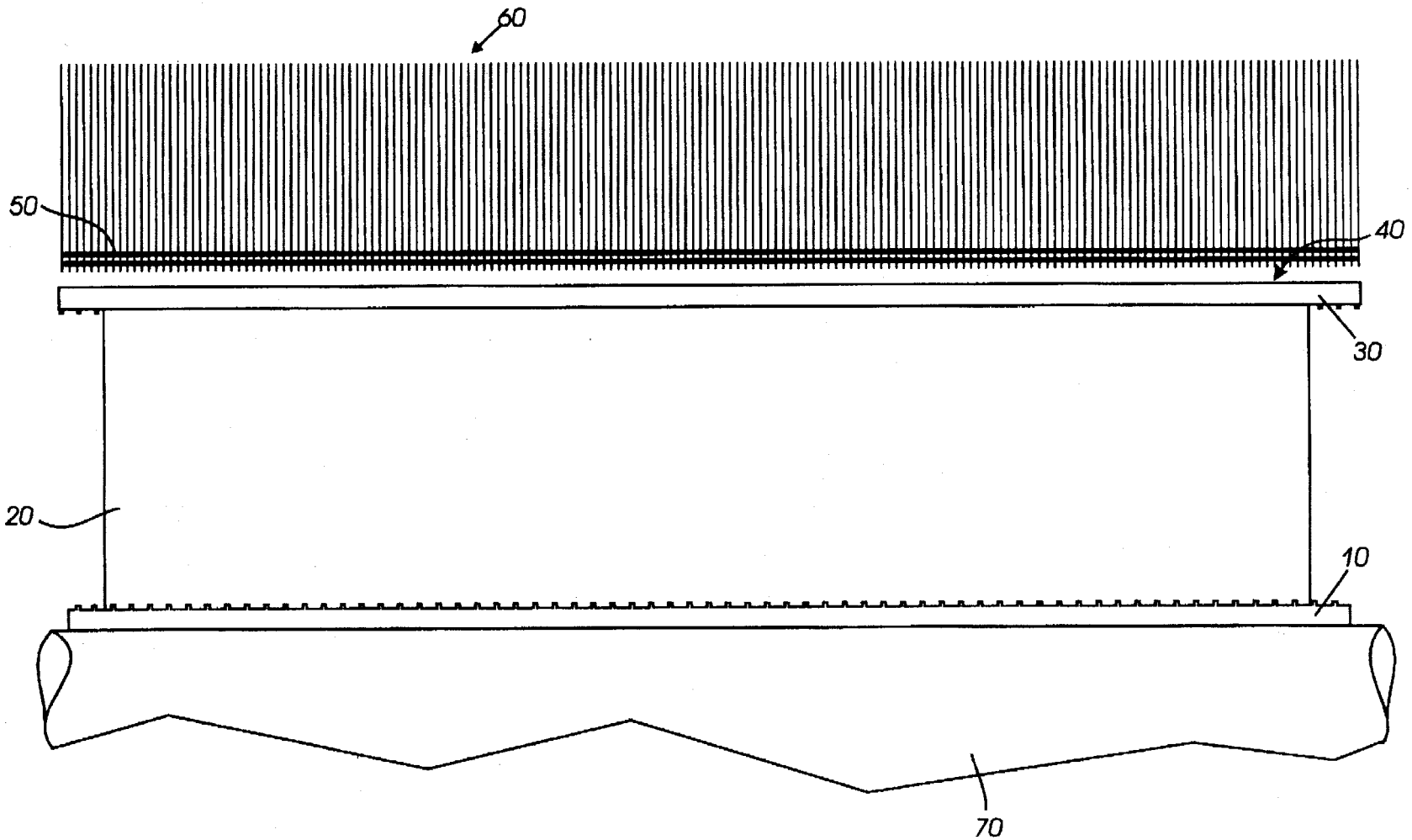
FIG. 1 is a cross-sectional view of a mandrel with an encapsulated electroform of the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of an electroforming process in which the present invention may be incorporated, reference is made to U.S. Pat. No. 4,501,646 which describes the conventional electroforming process using a core mandrel and hysteresis and U.S. Pat. No. 4,902,386 which describes an electroforming mandrel and method of fabricating and using same. The contents of these patents are herein incorporated by reference.

Reference is now made to the drawings where the showings are for the purpose of illustrating a preferred embodiment of the invention and not for limiting same.

In FIG. 1, a cross-sectional view of the present invention is shown. The mandrel 70 is plated by a metal (e.g. Nickel) to create the electroform 20. The electroform 20 is electroplated by a metal. This electroplated metal 10, 30 encapsulates the electroformed metal 20 to prevent wear on the encapsulated metal.

With continuing reference to FIG. 1, the bath side of the material deposit on the mandrel is made up of three layers, the CTL (charge transport layer 60), the CGL (charge generator layer 50), and the UCL (under coating layer 40). These layers are contained in the photoreceptive belt created by electroforming. A further explanation of the photoreceptor and the layers of which the belt is made is as follows.

Electrostatographic flexible belt imaging members are well known in the art. Typical electrostatographic flexible belt imaging members include, for example, photoreceptors for electrophotographic imaging systems and electroceptors or ionographic members for electrographic imaging systems.

Electrostatographic flexible belt imaging member may be prepared by various suitable techniques. Typically, a flexible substrate is provided having an electrically conductive surface. For electrophotographic imaging members, at least one photoconductive layer is then applied to the electrically conductive surface. A charge blocking layer may be applied to the electrically conductive layer prior to the application of the photoconductive layer. If desired, an adhesive layer may be utilized between the charge blocking layer and the photoconductive layer. For multi-layered photoreceptors, a charge generation binder layer is usually applied onto the blocking layer and charge transport layer is formed on the charge generation layer. For ionographic imaging members, an electrically insulating dielectric layer is applied to the electrically conductive surface.

The thickness of the substrate layer depends on numerous factors, including beam strength and economical considerations, and thus this layer for a flexible belt may be of substantial thickness, for example, about 125 micrometers, or of minimum thickness less than 25 micrometers, provided there are no adverse effects on the final electrostatographic device. In one flexible belt embodiment, the thickness of this layer ranges from about 65 micrometers to about 150 micrometers, and preferably from about 75 micrometers to about 100 micrometers for optimum flexibility and minimum stretch when cycled around small diameter rollers, e.g. 19 millimeter diameter rollers. The surface of the substrate layer is preferably cleaned prior to coating to promote greater adhesion of the deposited coating. Cleaning may be effected, for example, by exposing the surface of the substrate layer to plasma discharge, ion bombardment and the like.

After formation of an electrically conductive surface, a hole blocking layer may be applied thereto for photoreceptors. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino) titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,291,110, 4,338,387, 4,286,033 and 4,291,110. The disclosures of U.S. Pat. No. 4,338,387, 4,286,033 and 4,291,110 are incorporated herein in their entirety. A preferred blocking layer comprises a reaction product between a hydrolyzed silane and the oxidized surface of a metal ground plane layer. The oxidized surface inherently forms on the outer surface of most metal ground plane layers when exposed to air after deposition. The blocking layer may also be polymeric resins such as nylon, polyester, polycarbonates, polyvinylbutye, and the like. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. The blocking layer should be continuous and have a thickness of less than about 0.2 micrometer because greater thickness may lead to undesirable high residual voltage.

An optional adhesive layer may applied to the hole blocking layer. Any suitable adhesive layer well known in the art may be utilized. Typical adhesive layer materials include, for example, polyesters, dupont 49,000 (available from E.I. dupont de Nemours and Company), Vitel PE100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the adhesive blocking layer which can then be overcoated with a contiguous hole transport layer as described hereinafter. Examples of typical photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from dupont under the tradename Monastral Red, Monastral violet and Monastral Red Y, Vat orange 1 and Vat orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired. Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infra-red light.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 65 percent by volume of the photogenerating pigment is dispersed in about 35 percent by volume to about 80 percent by volume of the resinous binder composition The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is related to binder content. Higher binder content compositions generally require thicker layers for photogeneration. Thickness outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multilayered photoconductor of this invention comprises from about 25 percent to about 75 percent by weight of at least one charge transporting aromatic amine compound, and about 75 percent to about 25 percent by weight of a polymeric film forming resin in which the aromatic amine is soluble.

The charge transport layer forming mixture preferably comprises an aromatic amine compound of one or more compounds having the general formula:

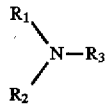

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as $NO_2$ groups, CN groups, and the like.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4'-4"-bis(diethylamino)-2',2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 150,000.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the hole transport layer is between about 5 micrometers to about 50 micrometers, but thickness outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

The preferred electrically inactive resin materials are polycarbonate resins have a molecular weight from about 20,000 to about 150,000, more preferably from about 50,000 to about 120,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 120,000, available as Makrolon from Farbenfabricken Bayer A. G. and a polycarbonate resin having a molecular weight of from about 20,000 to about 50,000 available as Merlon from Mobay Chemical Company. Methylene chloride solvent is a desirable component of the charge transport layer coating mixture for adequate dissolving of all the components and for its low boiling point.

Examples of photosensitive members having at least two electrically operative layers include the charge generator layer and diamine containing transport layer members disclosed in U.S. Pat. Nos. 4,265,990, 4,233,384, 4,306,008, 4,299,897 and 4,439,507. The disclosures of these patents are incorporated herein in their entirety. The photoreceptors may comprise, for example, a charge generator layer sandwiched between a conductive surface and a charge transport layer as described above or a charge transport layer sandwiched between a conductive surface and a charge generator layer.

The present invention is a nickel photoreceptor substrate plated on the inside and outside with a metal (i.e. to encapsulate the nickel electroform) so that the resulting electroform has the mechanical properties of nickel but the nickel is not exposed, thus, will not wear nor cause hazardous nickel dust to be released from the electroform. The outer diameter of the electroform ranges from about 0.5 microns to about 50 microns and the inner diameter range from about 0.5 microns to about 25 microns. The surface of the mandrel is plated with a nickel material having a thickness ranging from about 12 microns to about 250 microns. The nickel material is then plated with another material as described in the next paragraph having a thickness ranging from about 25 microns to about 70 microns.

In the present invention, the photoreceptor belt is electroformed on a mandrel and parted in the conventional manner and then plated with, for example, Ti (titanium), Zr (zirconium), Brass, Sn (tin), Cobalt. Parting of an electroformed part from a mandrel in the "conventional way" is described in U.S. Pat. No. 4,501,646, the entire disclosure of which is incorporated herein in its entirety. The resulting composite will have no exposed nickel. In the embodiments where the belt includes Ti and Zr, a surface chemistry/physics which is expected to be superior to Ni or Al as a photoreceptor interface.

The resulting electroform will have the mechanical properties of a nickel electroform. These materials must adhere well to nickel so that the nickel material exposed.

In recapitulation, the present invention utilizes an electroformed nickel photoreceptor belt that is encapsulated by another material on the outside diameter and the inside diameter of the photoreceptor belt to prevent wear on the nickel. By preventing wear on the nickel belt, the belt life is increased and the potential hazardous dust that results from the nickel is eliminated by the use of encapsulation.

It is, therefore, apparent that there has been provided in accordance with the present invention, an encapsulated nickel photoreceptor belt that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A method for fabricating an electroform on a mandrel, comprising:

applying a layer of a nickel material to a surface of the mandrel to create an electroform;

separating the layer of the nickel material forming the electroform from the mandrel surface; and encapsulating the nickel material on an inside diameter and an outside diameter of the electroform with another material to prevent wear of said nickel material creating a photoreceptor belt.

2. A method as recited in claim 1, wherein the applying step comprises plating the surface of the mandrel with the layer of the nickel material having a thickness ranging from about 12 microns to about 250 microns forming a surface electroform.

3. A method as recited in claim 2, wherein the separating step comprises:

parting the nickel material of the electroform from the mandrel surface using hysterisis to maintain the mandrel surface; and removing the nickel material of the electroform, along a longitudinal axis of the mandrel surface, to separate the mandrel surface from the nickel material of the electroform.

4. A method as recited in claim 3, wherein the encapsulating step comprises adhering the other material to the nickel material during plating of the nickel material with the second material, the other material having a thickness ranging from about 25 microns to about 70 microns.

5. A method as recited in claim 4, wherein the other material is chosen from a group of materials consisting of cobalt, brass, tin, zirconium and titanium.

* * * * *